US011306633B2

(12) United States Patent
Hinz et al.

(10) Patent No.: US 11,306,633 B2
(45) Date of Patent: Apr. 19, 2022

(54) OIL SEPARATING DEVICE

(71) Applicant: BRUSS SEALING SYSTEMS GMBH, Hoisdorf (DE)

(72) Inventors: Torge Hinz, Hamburg (DE); Artur Knaus, Hamburg (DE); Stephan Rust, Hamburg (DE); Manfred Brand, Tremsbüttel (DE)

(73) Assignee: BRUSS SEALING SYSTEMS GMBH, Hoisdorf (DE)

( * ) Notice: Subject to any disclaimer, the term of this patent is extended or adjusted under 35 U.S.C. 154(b) by 0 days.

(21) Appl. No.: 16/952,788

(22) Filed: Nov. 19, 2020

(65) Prior Publication Data

US 2021/0148260 A1 May 20, 2021

(30) Foreign Application Priority Data

Nov. 20, 2019 (DE) ..... 102019217901.0

(51) Int. Cl.
*F01M 13/04* (2006.01)

(52) U.S. Cl.
CPC . *F01M 13/0416* (2013.01); *F01M 2013/0433* (2013.01)

(58) Field of Classification Search
CPC ..... F01M 2013/0433; F01M 13/0416
See application file for complete search history.

(56) References Cited

U.S. PATENT DOCUMENTS 4,579,092 A * 4/1986 Kandler ..... F01L 1/04 123/196 CP
2002/0100465 A1 8/2002 Pietschner
2003/0075046 A1* 4/2003 Lenzing ..... B01D 45/06 95/267
2004/0261776 A1* 12/2004 Knaus ..... F01M 13/022 123/572
2007/0256566 A1* 11/2007 Faber ..... B01D 45/08 96/417
2017/0014745 A1* 1/2017 Zuerker ..... B01D 46/002
2017/0225107 A1 8/2017 Janssen et al.
2020/0018202 A1 1/2020 Hinz et al.
(Continued)

FOREIGN PATENT DOCUMENTS

DE 100 51 307 A1 5/2002
DE 20 2017 101 622 U1 5/2017
DE 10 2018 211 760 A1 1/2020
(Continued)

*Primary Examiner* — Kevin A Lathers
(74) *Attorney, Agent, or Firm* — Saliwanchik, Lloyd & Eisenschenk

(57) ABSTRACT

The present invention relates to an oil separating device for crankcase ventilation of an internal combustion engine, comprising an oil separator having a gas inlet line, which has an outlet end, and a gap-defining element, wherein the gas inlet line for flowing blow-by gas has an inner wall and an outer wall, wherein an inner annular gap is formed or can be formed between the gap-defining element and the outlet end on the inner wall of the gas inlet line and an outer annular gap is formed or can be formed between the gap-defining element and the outlet end of the outer wall of the gas inlet line, wherein, in the flow direction, an inner baffle is arranged behind the inner annular gap and an outer baffle is arranged behind the outer annular gap.

20 Claims, 7 Drawing Sheets

(56) References Cited

U.S. PATENT DOCUMENTS

2020/0088076 A1 3/2020 Burkert

FOREIGN PATENT DOCUMENTS

| | | | |
|---|---|---|---|
| EP | 1 285 152 | B1 | 2/2004 |
| EP | 1 273 335 | B1 | 9/2005 |
| EP | 3 192 987 | A1 | 7/2017 |
| WO | WO 2001/092690 | A1 | 12/2001 |
| WO | WO 2016/015976 | A1 | 2/2016 |

* cited by examiner

OIL SEPARATING DEVICE

CROSS-REFERENCE TO A RELATED APPLICATION

This application claims priority under 35 U.S.C. § 119(e) of German Patent Application No. DE 10 2019 217 901.0, filed on Nov. 20, 2019, which is incorporated herein by reference in its entirety.

FIELD OF THE INVENTION

The present invention relates to an oil separating device for crankcase ventilation of an internal combustion engine, comprising an oil separator having a gas inlet line, which has an outlet end, and a gap-defining element. The invention also relates to a corresponding system for crankcase ventilation of an internal combustion engine.

BACKGROUND OF THE INVENTION

DE 100 51 307 B4, EP 1 285 152 B1 and WO 2016/015976 A1, for example, disclose oil separating devices having a rigid plate that is displaceable against the force of a spring.

EP 3 192 987 A1 discloses an oil separating device of the type mentioned at the outset. The gap between the gap-defining element and the inlet pipe is set on the basis of the preload and spring rate of a spring and the dynamic pressure of the blow-by gas flowing through. Subsequently, the relevant pressure loss for a specific volume flow is obtained. The separator must be designed as a compromise between the existing negative pressure level, the blow-by gas that occurs and the negative pressure required in the crankcase. High negative pressure levels can therefore not always be exhausted, but must be regulated or throttled with additional components, in particular a pressure regulating valve, without this potential being used for more efficient separation. Furthermore, the design is a compromise of the available space.

Alternatively, EP 1 273 335 B1, for example, discloses electrically driven plate separators. In the case of such active separators, the pressure drop across the separating device can advantageously be regulated. However, electrically driven plate separators are complex and therefore costly.

BRIEF SUMMARY OF THE INVENTION

The object of the invention is to provide a comparatively simple oil separating device having a small structural volume, increased separation efficiency with improved utilisation of the existing negative pressure level.

The invention achieves this object by means of the features of the independent claims. Further preferred embodiments of the invention can be found in the drawings, the dependent claims and the associated description.

To achieve the object, an oil separating device for crankcase ventilation of an internal combustion engine is thus proposed, comprising an oil separator having a gas inlet line, which has an outlet end, and a gap-defining element. According to the invention, the gas inlet line for flowing blow-by gas has an inner wall and an outer wall, wherein an inner annular gap is formed or can be formed between the gap-defining element and the outlet end on the inner wall of the gas inlet line and an outer annular gap is formed or can be formed between the gap-defining element and the outlet end of the outer wall of the gas inlet line. In the flow direction, an inner baffle is arranged behind the inner annular gap and an outer baffle is arranged behind the outer annular gap.

Blow-by gas from the crankcase ventilation is directed via the gas inlet line to the outlet end of the gas inlet line. The gap-defining element is supplied with the oil-loaded blow-by gas via the gas inlet line. The gap-defining element is arranged at a distance from the outlet end on the inner and outer wall of the gas inlet line, which preferably corresponds to an annular nozzle, so that two gaps, in particular two annular gaps, are formed between the gas inlet line and the gap-defining element. The two annular gaps are preferably without interruption and are furthermore preferably formed so as to be annular, particularly preferably circular. In addition, in alternative embodiments, the two annular gaps can also, independently of one another, have non-circular shapes, for example ellipses or ovals.

The blow-by gas flows through the inner annular gap and the outer annular gap at high speed, with the gas stream being divided between the two annular gaps. The inner annular gap preferably has a smaller circumference and/or diameter than the outer annular gap.

The gas flowing out through the annular gaps strikes the downstream baffles, with the part emerging through the inner annular gap flowing in the direction of the inner baffle in accordance with the division of the gas stream. In contrast, the part of the gas stream emerging through the outer annular gap flows in the direction of the outer baffle. Consequently, the flow direction of the emerging gas stream for the inner and outer annular gap is different, preferably opposite. There is accordingly an inwardly directed and an outwardly directed gas stream. The two gas streams emerging through the annular gaps run approximately perpendicularly towards the respective baffles and are sharply deflected. Due to the inertia of the oil and dirt particles in the blow-by gas, they are separated at the two baffles.

The proposed oil separating device is characterised in particular by a small space requirement for a specific volume flow with a good degree of separation efficiency. In this way, the same volume flow can be achieved in a smaller installation space as when using a plurality of smaller oil separators within one oil separating device. In addition, the comparison results in a simplified production and an easier adaptation to production tolerances, since only the gap of one oil separator has to be set; compared to a plurality of smaller oil separators arranged next to one another with the same gap separation principle for the same volume flow. Furthermore, a large length of the gap can be realised in a small area or in a small structural volume by means of the proposed oil separating device.

In a preferred embodiment, the inner annular gap and the outer annular gap are arranged concentrically. This is advantageous in the case of a central attachment in the centre of both annular gaps and improves a uniform response behaviour to pressure changes over the entire length of the gap. In a further particularly advantageous embodiment, the distance between the two concentrically arranged annular gaps is constant, which allows a consistently high degree of separation efficiency over the entire length of the gap.

In a further preferred embodiment, the inner annular gap and the outer annular gap are arranged in a common plane. The arrangement of the annular gaps in a common plane allows for a simpler production and the same degree of separation efficiency of the inner and outer annular gap.

The inner baffle and the outer baffle are preferably arranged concentrically to one another, which likewise ensures a uniformly high degree of separation efficiency over the entire length of the two annular gaps. In advantageous embodiments, the distance between the inner annular gap and the inner baffle is constant over the circumference, and the distance between the outer annular gap and the outer baffle is constant. In preferred embodiments, both distances are the same, wherein, in alternative advantageous embodiments, the inner distance can be made larger than the outer distance in order to compensate for the narrowing of the radially inwardly directed flow relative to the outwardly directed flow. This allows both parts of the gas stream to expand equally.

The inner baffle and the outer baffle preferably have an annular design. The baffles can particularly preferably be formed so as to be circular. However, alternative advantageous embodiments of annular baffles are also possible, for example as an oval or ellipse or a rounded shape.

In an advantageous embodiment, the carrier of the gap-defining element can be inserted and connected into the baffle carrier with the gap-defining element. In this context, "can be inserted" means that the parts are positioned in a specific manner with respect to one another. The connection can be implemented, for example, as a form-fitting connection, for example clipping, or an substance-to-substance bond, for example welding. This embodiment has advantages in terms of production compared to a one-piece embodiment in which the baffle carrier, the carrier for the gap-defining element and the gap-defining element are produced integrally, since only a narrow gap having a relatively large depth is present between the carrier and the baffles in the region of the gas outlet openings. The production of the narrow gap can be bypassed in this way compared to a one-piece production.

In an alternative embodiment, the carrier of the gap-defining element and the baffle carrier are in one piece, wherein the gap-defining element can be inserted and connected into the carrier. This embodiment also avoids the production problems of the gap between the baffles and the gap-defining element.

In an advantageous embodiment, the oil separating device comprises a spring, a spring preloading element and a carrier attached to the gas inlet line, which are designed to effect spring preloading onto the gap-defining element with respect to the gas inlet line, wherein latching means are provided between the spring preloading element and the carrier. A latching means can be used for simple assembly by rotating the spring preloading element on the carrier with spring preloading of the spring.

In an advantageous embodiment, at least two stepped latching means are provided between the spring preloading element and the carrier. The stepped latching means allow for different spring preloads; i.e. the distance between the contact surface of the spring on the spring preloading element and the carrier attached to the gas inlet line and thus also on the gap-defining element in an unloaded state can be varied according to the steps. Depending on the spring preloading, the characteristics of the oil separator can be set differently, in particular with regard to the pressure loss. The plurality of stepped latching means provided allows the characteristics of the oil separator to be set by means of different strong spring preloads during assembly. Different oil separators can thus be produced with the same components or tolerances of the spring or the enclosure can be compensated for.

In a particularly advantageous embodiment, the oil separating device has a driven actuator for adjusting the gap-defining element relative to the outlet end of the gas inlet line.

Since the oil separating device has a driven actuator for adjusting the gap-defining element relative to the gas inlet line, the separation behaviour of the oil separator and/or the (negative) pressure regulation by the oil separator can be actively set at any time as desired. This allows, for example, a control and/or regulation of the oil separation and/or (negative) pressure regulation depending on the engine load, for example also depending on the engine map, and/or depending on the existing and possibly measured pressure conditions.

An active gap control by the actuator and an advantageous control means that regulates the gap on the basis of a (differential) pressure, e.g. the crankcase pressure or the pressure loss across the oil separating device, considerably increases the effectiveness of the oil separating device in the regions of unused "negative pressure energy". Such an advantageous control means can also be used to implement a map-controlled crankcase pressure regulation, or a map-controlled pressure drop over that of the oil separating device.

The actuator is preferably driven electrically. In a preferred embodiment, the actuator is an electromagnet since it reacts quickly and thus quick setting or regulation is possible.

The actuator preferably adjusts the gap-defining element against the force of a spring. The spring can hold the gap-defining element in the idle state, i.e. in the case of an electrical actuator in the de-energised state, in a position with the maximum gap width of the annular gap. In this case, the actuator does not have to be operated when the engine is idling and in low load states, which saves energy.

The gas inlet line is preferably attached to a carrier fixed to the housing. In this case, a shaft or axle for adjusting the gap-defining element can advantageously be mounted displaceably and/or rotatably in a through-hole of the carrier. In order to prevent dirt or oil from passing through the through-hole, an annular sealing element is advantageously provided for sealing off the shaft or axle with respect to the through-hole.

The actuator is advantageously attached to the carrier. This allows the actuator to be pre-assembled on the carrier. In particular, the carrier can be connected to a housing of the oil separating device, in particular it can be pushed or inserted into the housing. The actuator is then arranged, together with the carrier, advantageously so as to be protected within the housing of the oil separating device. In this embodiment, electrical contacts, in particular insulation-displacement contacts, are particularly advantageously provided on the carrier and on the housing, the contacts contacting one another automatically as a result of connecting the carrier to the housing. In this case, the electrical contact for an electrical actuator is reliably established automatically without any further work steps.

The oil separating device preferably has an oil return for returning separated oil into the crankcase. An intermediate oil reservoir is advantageously arranged in the oil return. Furthermore, a check valve is arranged in the oil return upstream and/or downstream of the intermediate oil reservoir. The intermediate oil reservoir can advantageously have a compressed air connection in order to expel oil out of the intermediate oil reservoir by supplying compressed air to the compressed air connection. In another embodiment, the intermediate oil reservoir can have a pump connection and a membrane connected to it in order to expel oil out of the intermediate oil reservoir by applying pressure pulsations to the pump connection.

Since the pressure losses over the oil separating device can be considerable in some regions and the installation space for oil reservoirs is often limited, conventional oil returns, which lead the separated oil back into the crankcase due to the built-up hydrostatic pressure, may no longer be sufficient. Although such returns are also possible within the scope of the invention, they can no longer return the separated oil at every operating point. By expediently dimensioning two combined returns, pulsations at the pump connection can be used to pump oil back. This effect can be enhanced by a membrane. A targeted pressure surge via the pressure connection into the intermediate oil reservoir is also suitable for emptying it.

The invention further provides a system for crankcase ventilation of an internal combustion engine having an oil separating device described above and an electronic control means for adjusting, controlling and/or regulating the gap width s of the oil separator by correspondingly triggering the actuator.

Advantageously, the control means adjusts, controls and/or regulates the gap width on the basis of the signal from at least one pressure sensor, differential pressure sensor and/or on the basis of an engine map.

In general, the control means advantageously controls the gap width s in such a way that the gap width s is reduced (monotonically) with increasing engine load.

In any case, the control means advantageously controls the gap width in such a way that a negative pressure in the crankcase relative to atmospheric pressure is ensured in all operating states of the engine in order to prevent harmful gases from escaping into the environment under any circumstances.

In a particularly advantageous embodiment, the crankcase ventilation system has an ejector pump which is connected in series with the oil separating device in the gas stream and has a propellant gas connection that can be supplied with propellant gas and a nozzle connected to the propellant gas connection, wherein propellant gas flowing out of the nozzle advantageously promotes the flow of gas through the oil separating device. Such an ejector pump allows pressure losses over the oil separating device to be compensated for, particularly when the engine load is high. A suction connection of the ejector pump can be connected to a gas outlet of the oil separating device (suction arrangement) or a pressure connection of the ejector pump can be connected to a gas inlet of the oil separating device (pressure arrangement).

It is possible to forego high separation efficiency for a short time and to reduce the pressure loss to a value that sets a pressure in the clean space which (including the possible hydrostatic pressure gain in the return line) is greater than the pressure in the crankcase. The arrangement of the ejector pump can be significant in this case. For instance, with an upstream ejector pump (pressure arrangement), the pressure loss can be set so that it is only slightly below the negative pressure gain from the ejector pump, which then automatically fulfils the return condition.

BRIEF DESCRIPTION OF THE FIGURES

The invention will be explained below on the basis of preferred embodiments with reference to the accompanying drawings, in which.

DETAILED DESCRIPTION OF THE INVENTION

Figure 1:
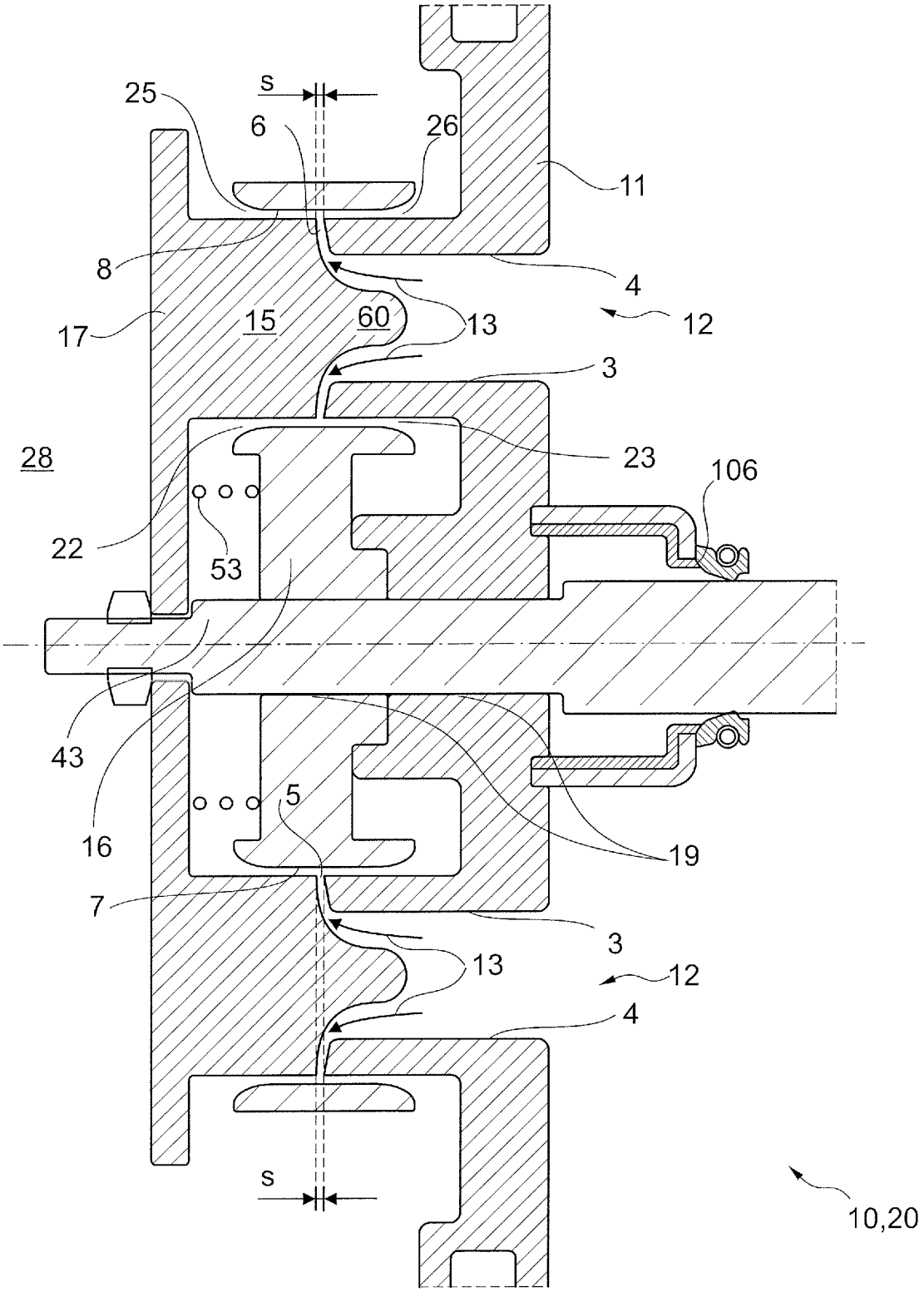
FIG. 1 is a cross section through an active oil separating device in the region of the oil separator.

The schematically represented oil separating device 10 according to FIG. 1 to 7 comprises an oil separator 20 which is held on a carrier 11 which is advantageously fixed to the housing. The carrier 11 carries a circular gas inlet line 12 for blow-by gas 13 from the crankcase ventilation of an internal combustion engine. The oil separating device 10 has an adjustable carrier 17 which forms or carries a gap-defining element 15. The carrier 11, on the other hand, is fixed to the housing, i.e. is arranged immovably in and relative to a housing 41 surrounding the oil separating device 10. The housing 41 can be a housing of the oil separating device 10 or a housing of a larger functional unit, for example a cylinder head cover. The adjustable carrier 17 is adjustable relative to the carrier 11, which will be explained in more detail.

The gap-defining element 15 is arranged at a distance S from the outlet end on the inner wall 3 and outer wall 4 of the gas inlet line 12, so that two gaps, in particular an inner annular gap 5 and an outer annular gap 6, are formed between the gas inlet line 12 and the gap-defining element 15. In this advantageous embodiment, the two annular gaps 5, 6 are formed without interruption and in the shape of a circular ring.

In alternative embodiments, the inner annular gap 5 and the outer annular gap 6 can deviate from the circular shape and have other closed curves, in particular rings. The gap-defined element 15 and the outlet end of the inner wall 3 and the outer wall 4 have curves corresponding thereto.

The blow-by gas 13 flows through the inner annular gap 5 and the outer annular gap 6 at high speed, the gas stream being divided between the two annular gaps 5, 6. The inner annular gap 5 has a smaller circumference and/or diameter than the outer annular gap 6.

The blow-by gas 13 flowing out through the annular gaps 5, 6 strikes the downstream baffles 7, 8, with the part emerging through the inner annular gap 5 flowing in the direction of the inner baffle 7 in accordance with the division of the blow-by gas stream 13. In contrast, the part of the gas stream emerging through the outer annular gap 6 flows in the direction of the outer baffle 8. Consequently, the flow direction of the emerging gas stream for the inner and outer annular gaps 5, 6 is opposite. There is accordingly an inwardly directed and an outwardly directed gas stream. The two gas streams emerging through the annular gaps 5, 6 run approximately perpendicularly towards the respective baffles 7, 8 and are sharply deflected. Due to the inertia of the oil and dirt particles in the blow-by gas 13, they are separated at the two baffles 7, 8. The baffles 7, 8 are preferably cylindrical, the inner baffle 7 being associated with the outer surface of a cylinder and the outer baffle 8 being associated with the inner surface of a cylinder.

The oil separated at the baffles 7, 8 is discharged from the two impactors through inner and outer oil outlet elements and from the oil separating device 10 through an oil outlet opening provided in the housing 41 and returned by gravity via an oil return 94 to the engine oil circuit.

Due to the annular gaps 5, 6 which extend around 360° between the rings of the baffle carrier 16 and the gas inlet line 12, a high separation performance results for each of the annular gaps 5, 6 of the oil separator 20. The oil separator 20 can therefore also be referred to as a gap impactor or annular gap impactor, with it also being possible to refer to the oil separator 20 as a double annular gap impactor due to the inner and outer annular gap 5, 6.

In another embodiment, the inner baffle 7 and the outer baffle 8 are formed in one piece with the gap-defining element 15 or are held thereon or attached thereto (see FIG. 4) and are adjusted together with the gap-defining element 15.

The outer diameter of the gap-defining element 15 can correspond, for example, to the outer diameter of the gas inlet line 12; see FIG. 1. The outer shape of the gap-defining element 15 can correspond to the shape of the gas inlet line 12 and, for example, be formed so as to be round or circular and alternatively elliptical or oval.

The carrier 11 and/or the housing 41 consist for example of a plastics material, in particular a reinforced or non-reinforced thermoplastic material. The carrier 11 is advantageously arranged as an intermediate wall in the housing 41 and divides the interior of the housing 41 into two spatial regions, namely a pre-separation space 29 upstream of the oil separator 20 in the direction of flow and a clean space 28 downstream of the oil separator 20 in the flow direction; see FIG. 2.

The oil separating device 10 can be integrated into a cylinder head cover or an oil separation module. Alternatively, the oil separating device 10 can be a separate component that is connected to other engine components, for example via hoses.

The gas inlet into the inner and outer annular gap 5, 6 is advantageously rounded. This is achieved, for example, by means of a rounded extension 60 on the gap-defining element 15, which extends into the gas inlet line 12 counter to the gas inlet direction; see FIG. 1.

Figure 8:
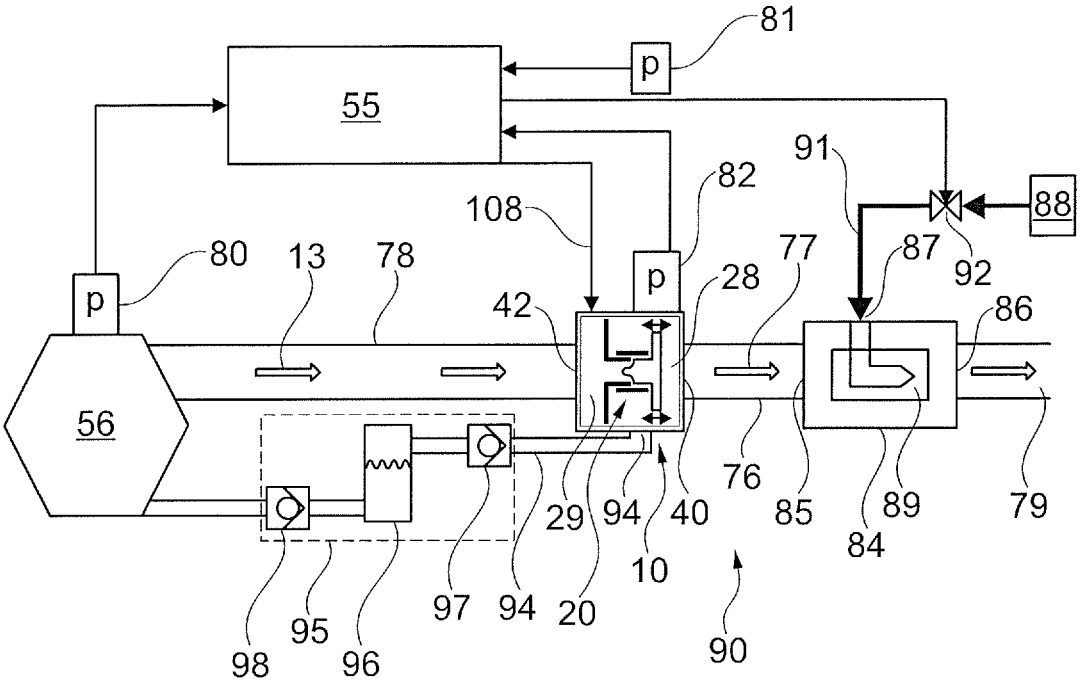
FIG. 8-10 are schematic representations of a system for ventilating the crankcase of an internal combustion engine in different embodiments.

Blow-by gas 13 from the crankcase ventilation is fed into the interior of the housing 41 into the pre-separation space 29 via a gas inlet 42 (see FIG. 8). The gap-defining element 15 is supplied with the oil-loaded blow-by gas 13 via the gas inlet line 12. The gap-defining element 15 is arranged at a distance s from the outlet end of the annular gas inlet line 12, so that two annular gaps 5, 6 with a gap width s are formed between the gas inlet line 12 and the gap-defining element; see FIG. 1. In preferred embodiments, the gap width s is the same at the inner annular gap 5 and at the outer annular gap 6, i.e. the two annular gaps 5, 6 preferably have the same minimum and maximum gap width s. In possible alternative embodiments, different gap widths s for the inner and outer annular gap 5, 6 can be achieved by adapting the gap-defining element 15 or by using outlet ends of the inner wall 3 with different depths in relation to the outer wall 4.

The inner baffle 7 and the outer baffle 8 are advantageously arranged concentrically with the gas inlet line 12, in particular concentrically with the inner wall 3 and the outer wall 4, and, as can be seen from FIG. 1, are arranged with an axial overlap inside and outside over the outlet end of the gas inlet line 12. The inner baffle 7 and the outer baffle 8 have mutually aligned surfaces. In the impactor, there is consequently an impactor function directed radially inward (inner baffle 7) and an impactor function directed radially outward (outer baffle 8), which leads to oil separation from the blow-by gas 13. Furthermore, the baffles 7, 8 advantageously have an annular design and are arranged at a distance from the carrier 11.

Figure 2:
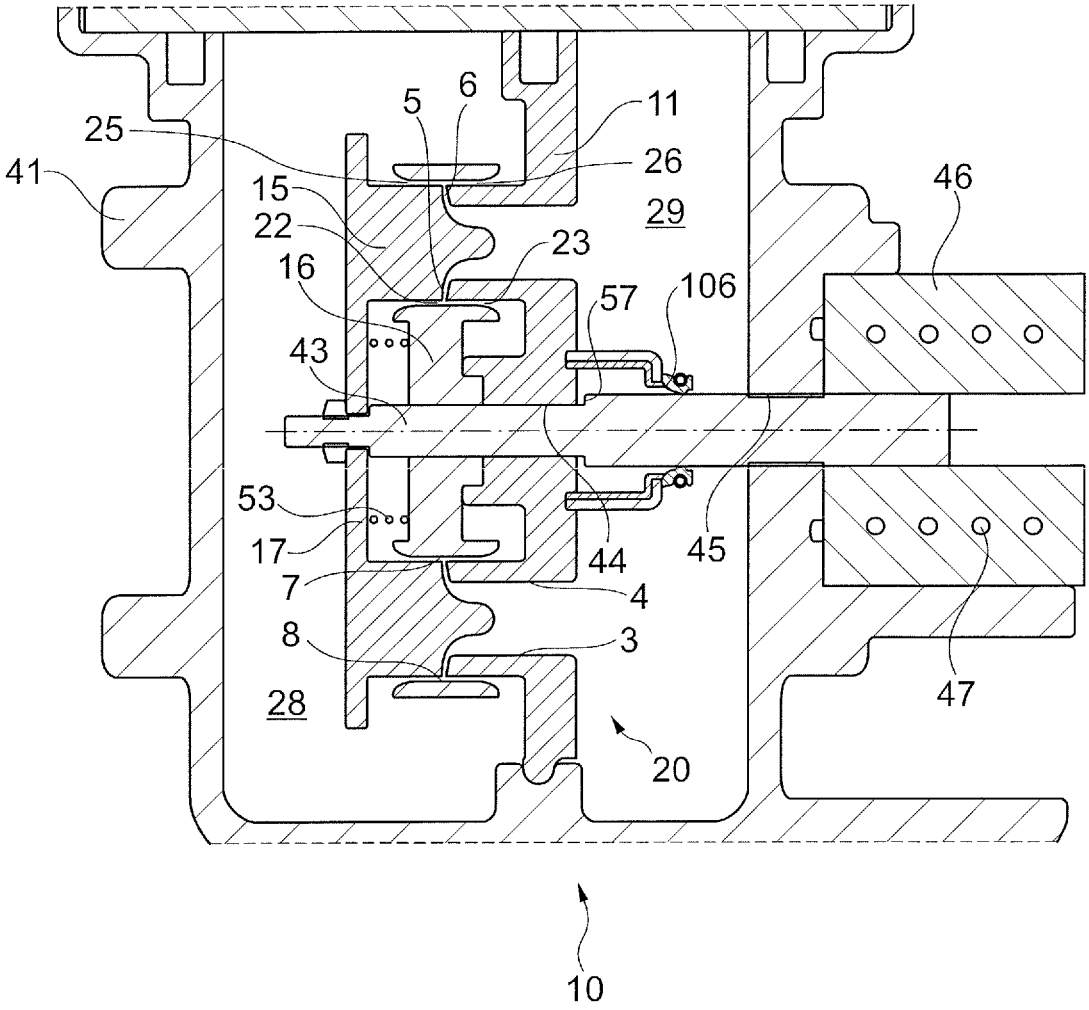
FIG. 2 is a cross section through an active oil separating device.

In the embodiment of FIGS. 1 and 2, the baffles 7, 8 have openings on both sides, meaning a two-sided outflow of the gas stream deflected at the baffles 7, 8 is possible. The gas stream deflected at the baffles 7, 8 flows on the one hand in the same flow direction as through the gas inlet line 12 through the corresponding inner gas outlet opening 22 and outer gas outlet opening 25 and on the other hand in the opposite direction through the radial space between the baffles 7, 8 and the gas inlet line 12 and through the opposite inner gas outlet opening 23 and the opposite outer gas outlet opening 26. The efficiency of the oil separator 20 compared to known separators can be increased by the two-sided outflow of the gas stream deflected at the baffles 7, 8 and in particular by the use of two annular baffles 7, 8. According to what has been said above, the openings between the gap-defining element 15 or the adjustable carrier 17 thereof and the baffles 7, 8 formed by the baffle carrier 16 are functional gas outlet openings 22, 25. The openings between the gas inlet line 12 or the carrier 11 thereof and the baffles 7, 8 formed by the baffle carrier 16 are also functional gas outlet openings 22, 25.

The two-sided outflow from the impactor can contain a type of diffuser inside and outside in the region of the gas outlet openings 22, 23, 25, 26, which reduces the gas velocity at the outlet and prevents the separated oil from being carried along.

In this advantageous embodiment, the gas inlet into the impactor takes place in the interior of the baffle carrier 16 through the gas inlet line 12.

The embodiments in FIGS. 1 and 2 show an oil separating device 10 which is provided for active gap control. In FIG. 1, a displaceable shaft 43 is connected to the gap-defining element 15 for this purpose, which shaft is connected to an actuator 46 in the embodiment in FIG. 2.

The embodiment shown in FIG. 3 to 6 shows a passive oil separating device 10 without active gap control. A passive oil separating device 10 accordingly does not have an electromagnet or electric motor which actively adjusts the gap or the annular gaps 5, 6. Passive oil separating devices 10 therefore do not have an actuator 46.

Figure 5:
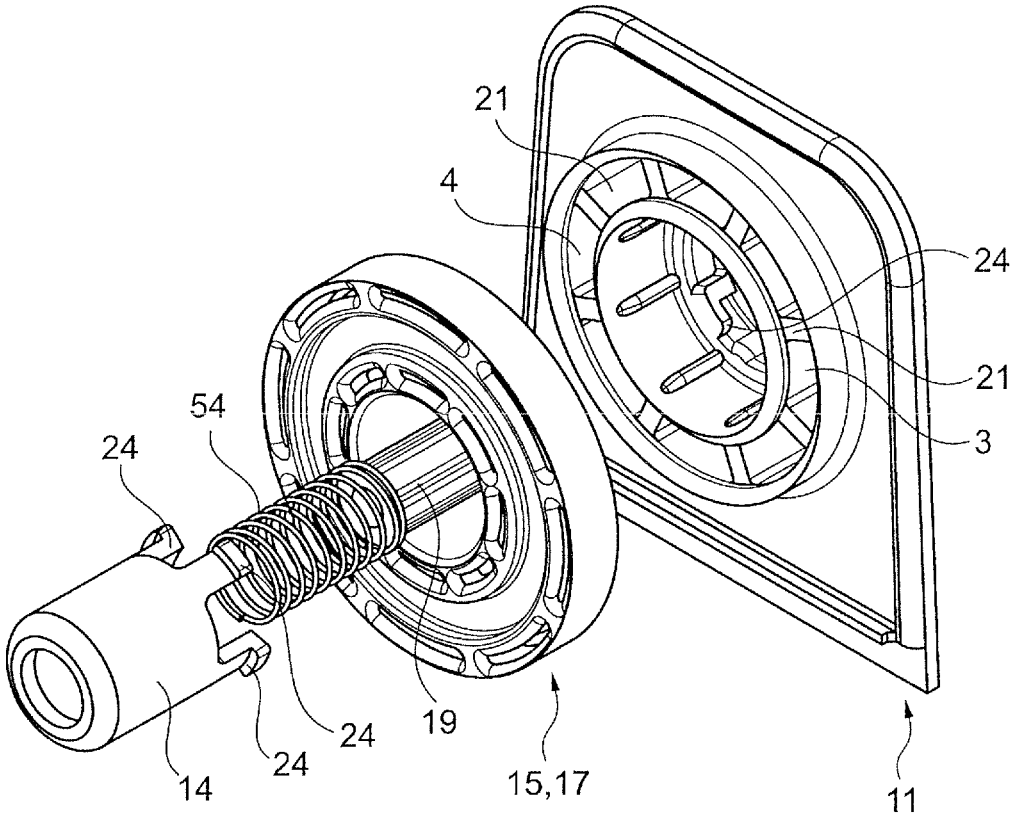
FIG. 5 is an exploded drawing of an oil separating device.
Figure 6:
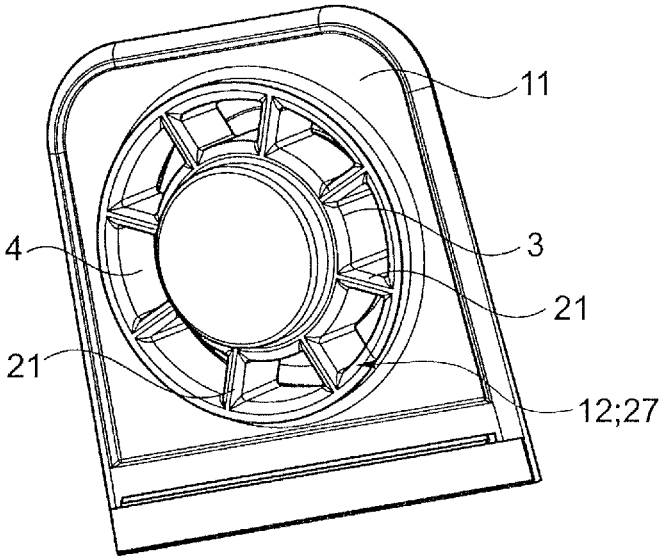
FIG. 6 shows a carrier of an oil separating device from the inlet side.
Figure 7:
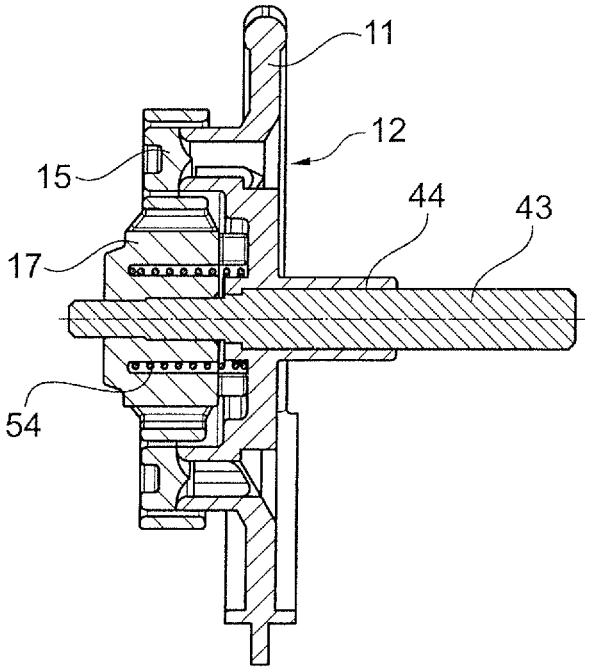
FIG. 7 shows an oil separating device having a displaceable shaft and spring.

In alternative advantageous embodiments, the embodiment in FIG. 3 to 6 can be changed with active gap control in accordance with the embodiments from FIGS. 1, 2 and 7. For this purpose, for example, the carrier 11 can be designed with a through-hole 44 for a shaft 43, wherein the shaft 43 is connected to the gap-defining element 15 and the two annular gaps 5, 6 can be actively controlled accordingly.

Figure 3:
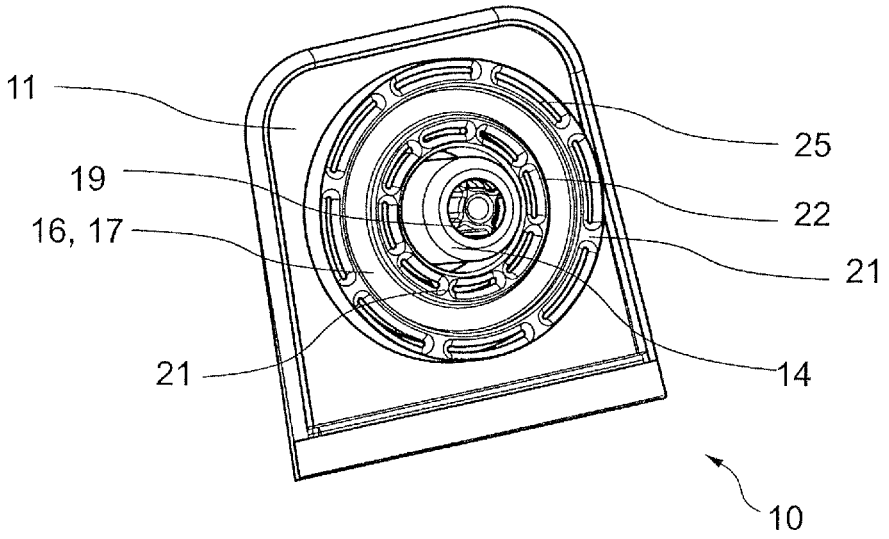
FIG. 3 is a perspective view of an oil separating device from the clean space side.

FIG. 3 shows a perspective view of a passive oil separating device 10, for example, from the side which is associated with the clean space 28. The carrier 11 for the gas inlet line 12, which cannot be seen from this side, as well as the carrier 17 for the gap-defining element 15, the baffle carrier 16 and the spring preloading element 14 are shown.

The carrier 17 of the gap-defining element 15 is advantageously formed in one piece therewith. Furthermore, in this advantageous embodiment, the carrier 17 is also formed in one piece with the baffle carrier 16. The gas outlet openings 22, 25, which have the same flow direction as the gas inlet line 12, are therefore provided with retaining webs 21 which, in this advantageous embodiment, establish the connection between the gap-defining element 15 and the baffle carrier for the inner and outer baffle 7, 8.

Figure 4:
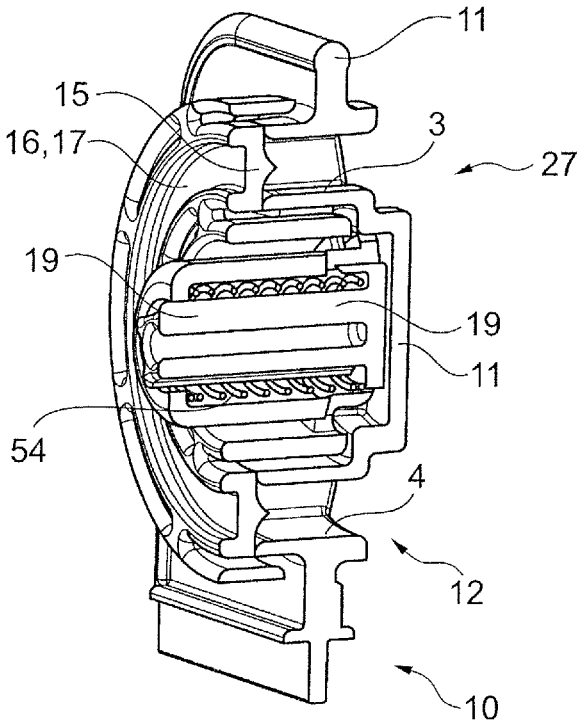
FIG. 4 is a cross section through the oil separating device from FIG. 3.

FIG. 4 shows a sectional representation of the oil separating device 10. The one-piece part of the baffle carrier 16 and of the carrier 17 is arranged concentrically to the annular gas inlet line 12 and slipped over it.

The carrier 11 is substantially planar or wall-shaped and has an annular through-opening 27 which forms the inlet opening of the gas inlet line 12. The gas inlet line 12 is advantageously formed in one piece with and from the carrier 11. On the inlet side, the through-opening 27 and in this embodiment also the gas inlet line 12 have a plurality of retaining webs 21 between the inner wall 3 and the outer wall 4, which establish the connection to the central part of the carrier 11; see FIG. 5.

A stroke guide 19 is provided which guides the carrier 17 of the gap-defining element 15 during the displacement thereof relative to the outlet end of the gas inlet line 12. This displacement can take place through the applied gas pressure of the blow-by gas 13 against the spring force of the spring 54, or can also take place in alternative embodiments with active gap control through the force applied by an actuator 46. In an advantageous embodiment, the stroke guide 19 is guided centrally through an opening in the preloading element 14, as a result of which a stroke movement is stabilised.

Passive oil separating devices 10 preferably have a spring 54 which causes a spring force that reduces the gap or the annular gaps 5, 6 to a minimum gap width s or, in possible embodiments, completely closes the annular gaps 5, 6, wherein the annular gaps 5, 6 are pressed to the maximum gap width with increasing applied gas pressure of the blow-by gas 13. In the case of an active oil separating device 10, the spring 53 is preferably designed in such a way that the spring force effects a maximum opening of the gap width s of the annular gaps 5, 6, wherein the actuator 46 preferably reduces the gap width s.

In particularly advantageous embodiments, the stroke guide 19 is made in one piece with the baffle carrier 16 and/or the carrier 17 of the gap-defining element 15, which means that the required installation space and the assembly effort can be kept particularly small; see FIG. 3 to 6.

In a further particularly advantageous embodiment, the stroke guide 19 and the baffle carrier 16 are made in one piece. The carrier 17 of the gap-defining element 15 can be inserted into the baffle carrier 16 and is held in it by a form-fitting connection, for example by clipping, or by an integral bond, for example by welding. This embodiment has particular advantages in terms of production, since there is only a very small gap between the carrier 17 and the baffles 7, 8 in the region of the gas outlet openings 22, 25, the production of which gap can be bypassed in this way compared to a one-piece production.

The guide can be coated with PTFE on one and/or both sides or one of the components, in this embodiment the preloading element 14 or stroke guide 19, can consist of a material containing PTFE or, alternatively, can consist of another lubricating and/or dirt-repellent material with good sliding properties.

In alternative advantageous embodiments, the stroke guide 19 can be provided in interaction with the shaft 43 in the carrier 11 and/or in the baffle carrier 16; see FIGS. 1 and 2.

FIG. 5 shows the for example passive oil separating device 10 in an exploded view, wherein the latching means 24 of the spring preloading element 14 and the carrier 11, which connect the spring preloading element 14 and the carrier 11 under spring preloading of the spring 54, can be seen. The spring 54 is supported on one side on the spring preloading element 14 and on the other side on the carrier 17 of the gap-defining element 15 and thus brings about spring preloading towards the outlet end of the gas inlet line 12.

The gap width s of the two annular gaps 5, 6 between the gap-defining element 15 and the inlet line 12 is set on the basis of the spring preloading and the spring stiffness of the spring 54 and the dynamic pressure of the blow-by gas 13 flowing through. This results in the relevant pressure loss for a specific volume flow.

In an alternative advantageous embodiment, the latching means 24 is multi-stage in that a plurality of latching means arranged at different depths are provided in the carrier 11 and are selected via the rotational position of the spring preloading element 14 relative to the carrier 11. The different depth causes a different spring preloading, which changes the characteristics of the oil separator 10 accordingly.

Furthermore, stepped latching means 24 are suitable for allowing tolerance compensation of the spring 54, so that the oil separating device 10 can be adjusted accordingly in a simple manner.

In a further alternative embodiment, springs 54 having a different spring stiffness can be used in order to allow different spring preloads.

FIG. 6 shows the inlet side of the passive oil separating device 10, for example, with the through-opening 27 and, in this embodiment, also the gas inlet line 12 having a plurality of retaining webs 21 between the inner wall 3 and the outer wall 4. In this embodiment of a passive oil separating device 10, no through-hole 44 is provided for a displaceable shaft 43.

In contrast with the previous embodiment in FIG. 3 to 6, the embodiment in FIG. 7 shows a through-hole 44 in the carrier 11 for a displaceable shaft 43, as a result of which the gap width s between the gap-defining element 15 and the gas inlet line 12 can be actively set and/or changed. For this purpose, the gap-defining element 15 is adjustable or displaceable relative to the gas inlet line 12, in particular axially displaceable, i.e. along the shaft defined by the gas inlet line 12. This is advantageously brought about by axial adjustment of the adjustable carrier 17 on which the gap-defining element 15 is attached. For this purpose, the axial carrier 17 is advantageously attached to the axially displaceable shaft 43.

The shaft 43 is advantageously mounted in the separating device 10, more precisely in a through-hole 44 through the carrier 11, so as to be axially displaceable. One mounting point or the mounting point is advantageously formed by a through-hole 44 through the carrier 11. Another mounting point can be formed by a through-hole 45 through a wall of the housing 41; see FIG. 2. However, a through-hole 45 through the housing 41 to the outside is advantageously dispensed with, which simplifies the assembly of the separating device 10. The shaft 43 is thus advantageously guided from the clean space 28, where it is attached to the displaceable carrier 17, through the carrier 11 into the pre-separation space 29.

In order to prevent dirt or oil from getting out of the pre-separation space 29 through the through-hole 44 into the clean space 28, the shaft 43 is preferably sealed off with respect to the carrier 11 with an annular sealing element 106, in particular a sealing ring with a spring-loaded or free (not loaded by an annular spring) sealing lip made of an elastomer or PTFE; see FIGS. 1 and 2.

The actuator 46 can alternatively be arranged on the other side of the carrier 11, i.e. on the side of the clean space 28. In this case, the through-hole 44 through the carrier 11 and/or the sealing element 106 can be dispensed with.

The adjustment of the shaft 43 takes place by means of an actuator 46, which is advantageously an electromagnet having a coil 47.

The shaft 43 is advantageously made of iron, an iron alloy or another ferromagnetic material, and is guided as an armature or core through the coil 47 of the electromagnet 46. The application of an electrical voltage to the coil 47 leads to a flow of current through the coil 47 and, in a manner known per se, to a magnetic force which acts on the shaft 43 in the axial direction. The electrical actuator 46, in particular the flow of current through the coil 47, is controlled or regulated by an electronic control means 55 (see FIG. 8 to 10) in order to set an appropriate gap width s depending on the measured negative pressure level. This will be explained in more detail below.

The actuator 46 can alternatively be an electric motor instead of an electromagnet. Instead of the axially displaceable shaft 43, a rotatable shaft or axle can be provided in an alternative embodiment (not shown), wherein the rotational movement of the shaft/axle is converted in a suitable manner, for example with a threaded connection or a gear, into an axial displacement of the displaceable carrier 17 or the gap-defining element(s) 15.

In a possible embodiment (not shown), the actuator 46 is arranged in the pre-separation space 29 of the oil separating device 10 and is advantageously attached to the carrier 11. In another embodiment, in which the shaft 43 extends to the outside through the housing 41, the actuator 46 can be arranged outside the housing 41, as is shown in FIG. 2.

In the advantageous embodiments in which the actuator 46 is attached to the carrier 11, the carrier 11 is advantageously a separate component from the housing 41 and can be pushed or inserted into the housing 41 or can be connected in some other way to the housing 41. For this purpose, the housing 41 advantageously has an intermediate wall which, together with the inserted carrier 11, forms a continuous partition wall between the clean space 28 and the pre-separation space 29. The partition wall forming the carrier 11 can for example have webs and the intermediate wall can have grooves into which the webs of the partition wall can be inserted, or vice versa.

In the embodiments described above, in which the actuator 46 is pre-assembled on the carrier 11 and this is connected to the housing 41, the carrier 11 and the housing 41 advantageously have contacts. In the operating state, in which the carrier 11 is connected to the housing 41 so as to be ready for operation, the contacts on the carrier 11 and the housing 41 come into contact in order to be able to conduct electrical current to the actuator 46 from an (also not shown) electrical connection (plug or socket) on the outside of the housing 41, which connection is connected in a conductive manner to the contacts of the housing 41 and can be connected to a power supply of the motor vehicle. The contacts are advantageously designed and arranged in such a way that the contacts come into contact as a result of the insertion or pushing of the carrier 11 into the housing 41, without any further measures. For this purpose, the contacts can particularly advantageously be designed as insulation-displacement contacts.

With the aid of the actuator 46, the gap width s of the oil separator 20 can be set or controlled or regulated as desired within a working range. This will be explained in more detail below. The working range of the adjustment can be limited by a suitable stop 57 (see FIG. 2) on the shaft 43, the adjustable carrier 17 and/or the gap-defining element 15 and/or corresponding stops 57 on parts fixed to the housing, for example the carrier 11.

The actuator 46 adjusts the adjustable carrier 17 and/or the gap-defining element(s) 15, preferably against the force of a spring 53, in particular a helical spring. The spring 53 advantageously holds the adjustable carrier 17 or the gap-defining element(s) 15 in a maximally open state, i.e. in a state in which the gap width s is at a maximum, when the actuator 46 is de-energised. This state can be defined by a stop 57; see FIG. 2. The maximum gap width is chosen so that the pressure losses in the case of a slight negative pressure in the clean space 28, i.e. for example when idling or in the low-load range, remain low and the pressure in the crankcase 56 remains negative. In general, a larger gap width is necessary in the low-load range than in the partial and full-load range in order to be able to reliably compensate for pressure losses.

With increasing engine load, the gap width s is advantageously reduced in order to achieve a better degree of separation of the oil separator 20. This is done by controlling or regulating the actuator 46, in this case, more precisely the current intensity through the coil 47, by means of an electronic control means 55 of the motor vehicle via a control line 108. With increasing engine load and thus increasing negative pressure levels, the actuator 46 adjusts the shaft 43, the carrier 17 and the gap-defining elements 15 against the force of the spring 53 (and the applied blow-by gas pressure) in the direction of a reduced gap width s, in this case by increasing the current intensity through the electromagnet 46. In the embodiments of the drawings, the actuator 46 pulls the carrier 17 and the gap-defining elements 15 towards it in order to reduce the gap width s.

The minimum possible gap width s can be zero and can be defined by placing the gap-defining element 15 on the gas inlet pipe 12. The minimum possible gap width s can be greater than zero and can be defined, for example, by a stop or stops 57.

The control or regulation of the gap width s on the basis of a differential pressure is explained in more detail below with reference to FIG. 8 to 10. A system 90 for ventilating the crankcase 56 of an internal combustion engine is shown therein in each case. The oil separating device 10 is generally connected between the crankcase 56 and the intake tract 79 of the internal combustion engine. More precisely, oil-loaded blow-by gases 13 are conveyed from the crankcase 56 via a blow-by line 78 to the oil separating device 10 and introduced via the gas inlet 42 into the pre-separation space 29 of the oil separating device 10, and are freed therein of liquid components by the at least one oil separator 20, and the cleaned gas 77 is fed to the intake tract 79 of the internal combustion engine via a clean gas line 76.

To determine a manipulated or controlled variable, one or more pressures are measured using pressure sensors 80, 81, 82 and/or at least one differential pressure is measured using at least one differential pressure sensor 83. In particular, a pressure sensor 80 for measuring the pressure in the crankcase 56, a pressure sensor 81 for measuring the atmospheric pressure and/or a pressure sensor 82 for measuring the pressure in the oil separating device 10, in particular in the clean space 28, can be provided. In the particularly simple embodiment according to FIG. 10, instead, only one differential pressure sensor 83 is provided for measuring the pressure on the gas inlet side of the oil separating device 10 relative to the atmospheric pressure (differential pressure $\Delta p$).

The measurement signals are sent to the electronic control means 55. The electronic control means 55 controls and/or regulates the oil separating device 10 via the control line 108 on the basis of the measurement signals from the pressure sensor(s) 80-83, for example on the basis of the pressure in the crankcase 56, or on the basis of the pressure loss across the oil separating device 10. In particular, by the adjustment of the gap-defining element 15, the gap width s between the gap-defining element 15 and the gas inlet pipe 12 is controlled and/or regulated depending on the available negative pressure level of the internal combustion engine, as described above.

Pressure losses over the oil separating device 10 can advantageously be compensated for, particularly at a high engine load level, using an ejector pump 84 connected in series with the oil separating device 10 between the crankcase 56 and the intake tract 57. The ejector pump 84 has a suction connection 85, a pressure connection 86 and a propellant gas connection 87.

Figure 10:
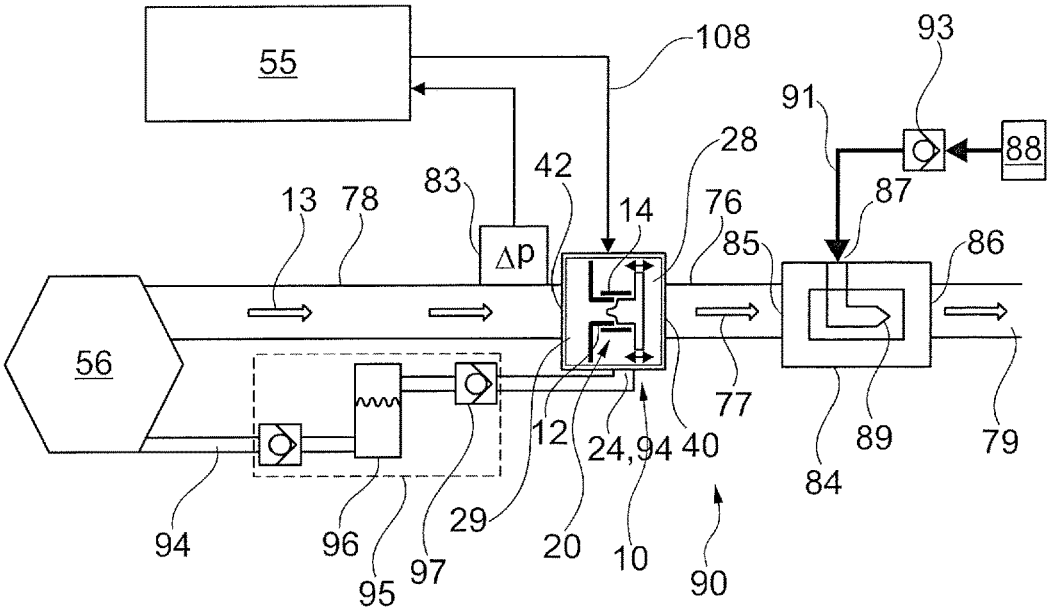

FIGS. 8 and 10 show a suction arrangement of the ejector pump 84. In this case, the suction connection 85 is connected to the gas outlet 40 of the oil separating device 10, through which the cleaned gas is discharged from the clean space 28 of the oil separating device 10. The pressure connection 86 is connected to the intake tract 79 of the internal combustion engine. The ejector pump 84 is arranged in this case on the suction side of the oil separating device 10. The oil separating device 10 is connected between the crankcase 56 and the ejector pump 84.

Figure 9:
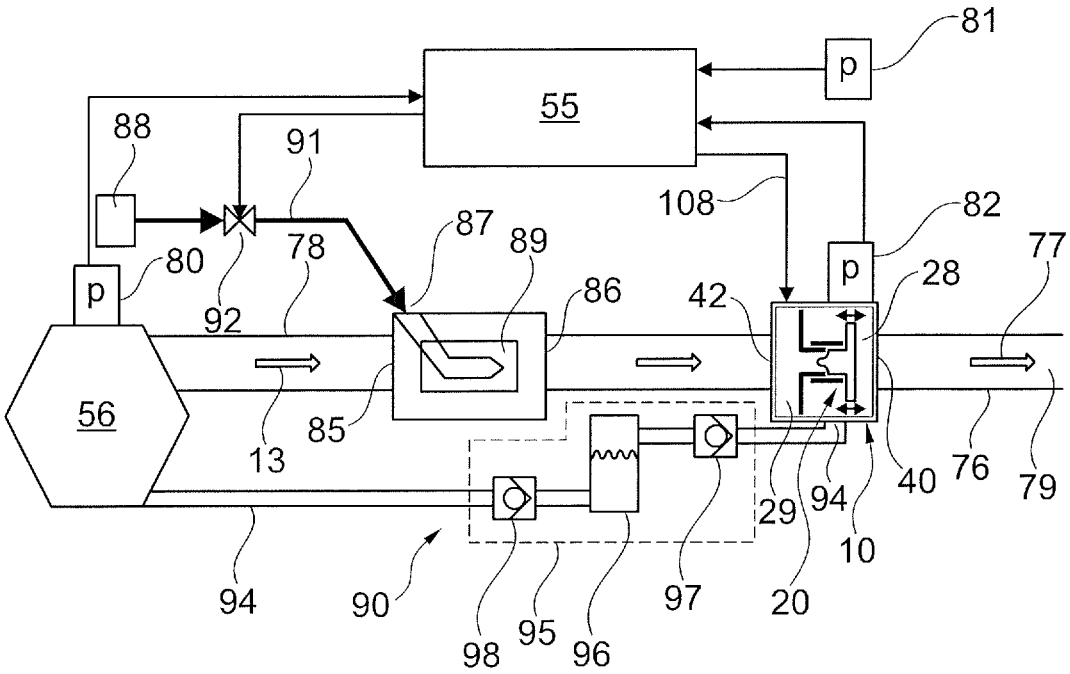

As an alternative, FIG. 9 shows a pressure arrangement of the ejector pump 84. In this case, the suction connection 85 is connected to the crankcase 56. The pressure connection 86 is connected to the gas inlet 42 of the oil separating device 10, through which the blow-by gas 13 flows into the pre-separation space 29 of the oil separating device 10. The ejector pump 84 is arranged in this case on the pressure side of the oil separating device 10. The ejector pump 84 is connected between the crankcase 56 and the oil separating device 10.

The propellant gas connection 87 is externally connected via a propellant air line 91 to a compressed air source 88 of the internal combustion engine, for example from the forced induction. The propellant air source provides, for example, a propellant pressure in the range between 0 bar and 2 bar. In the ejector pump 84, the propellant gas is directed to a nozzle 89 which is arranged in the ejector pump 84 so that the propellant gas exiting at high speed from the nozzle 89 flows and is effective in the flow direction of the blow-by gas stream 13 from the crankcase 56 to the intake tract 79. In this way, the suction effect of the intake tract 79 on the oil separating device 10 is supported, for example (in the suction arrangement) by a higher negative pressure at the suction connection 40, and accordingly in the pressure arrangement.

A valve 92 controllable by the electronic control means 55 can be arranged in the propellant air line 91. The control means 55 can then open the valve 92 in specific operating states of the engine, in particular with a high engine load or full load, or on the basis of the measured pressures or differential pressures, in order to apply compressed air to the propellant air connection 87 of the ejector pump 84 and thus activate the pumping action of the ejector pump 84, and can close the valve 92 in other operating states of the engine, in particular when idling or at part load, or on the basis of the measured pressures or differential pressures, in order to depressurise the propellant air connection 87 of the ejector pump 84 and thus deactivate the pumping action of the ejector pump 84 so that the effect of the ejector pump 84 is limited to a simple flow tube from the suction connection 85 to the pressure connection 86. Embodiments without a controllable valve 92 in the propellant air line 91 are possible; see for example FIG. 10. In these embodiments, the ejector pump 84 is constantly in the pumping operating mode regardless of the operating state of the engine. Since the charge air pressure in the forced induction usually increases steadily from zero bar at low engine load to higher engine load, there is an indirect load control in these embodiments, which has a favourable effect on the separation, as the incident blow-by gas and the particle concentration contained therein also increases.

A check valve 93 is then advantageously provided in the propellant air line 91 in order, depending on the pressure conditions, to prevent a malfunction of the ejector pump 84 in the reverse flow direction. In the embodiments of FIGS. 8 and 9, too, a check valve 93 can be provided in the propellant air line 91.

In order to be able to reliably return the separated oil to the crankcase 56 over a longer period of time even with a high separation efficiency of the oil separating device 10 and to avoid oil backflow into the oil separating device 10, a register arrangement 95 having an intermediate oil reservoir 96 is advantageously provided in the oil return 94. The inlet to the intermediate oil reservoir 96 is advantageously arranged at the upper end thereof and is provided with a check valve 97, for example in the form of a ball or spring-tongue check valve. The outlet from the intermediate oil reservoir 96 is advantageously arranged at the lower end thereof and is provided with a check valve 98, for example in the form of a ball or spring-tongue check valve.

Expedient dimensioning of the check valves, namely a large cross section and a small contact surface of the check valve 97 and a small cross section and a large contact surface of the check valve 98, allows pressure pulsations to be used to pump oil back into the crankcase 56.

Figure 11:
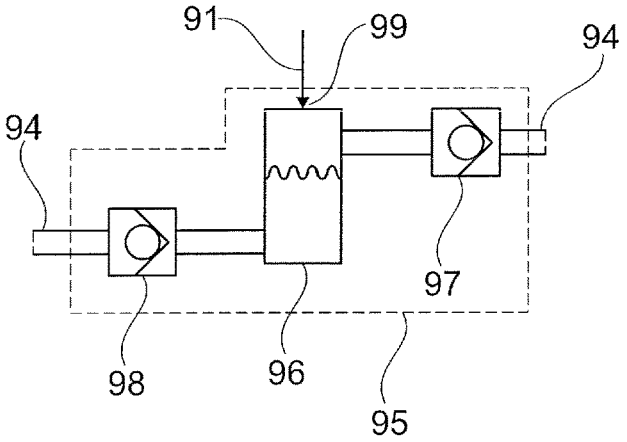
FIGS. 11 and 12 are schematic representations of register oil returns for an oil separating device in different embodiments.
Figure 12:
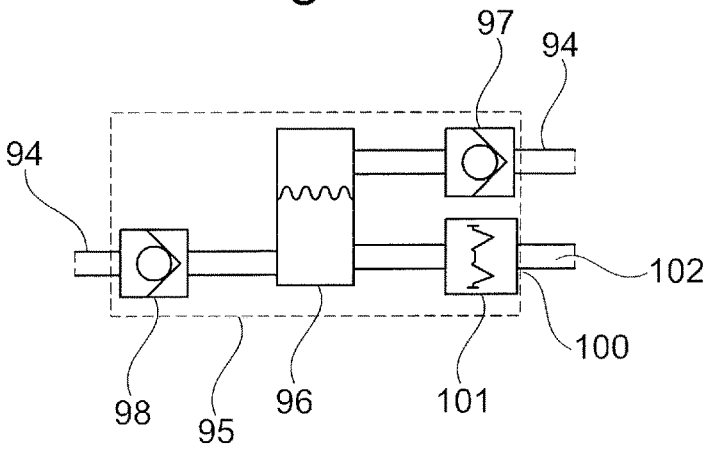

In the embodiment according to FIG. 11, the intermediate oil reservoir 96 also has a compressed air connection 99 which is connected, for example, to the propellant air line 91 or can be otherwise supplied with compressed air. By a targeted pressure surge through the compressed air connection 99 into the intermediate oil reservoir 96, the latter can be emptied. Alternatively, in the embodiment according to FIG. 12, a separate pump connection 100 is provided which is connected to a membrane 101. The pump connection 100 is connected via a line 102 to a space in which pressure pulsations occur during operation of the internal combustion engine, for example the intake tract 57 or the crankcase 56. The impacts exerted on the oil by the membrane 101 as a result of the pressure pulsations also contribute to expelling the oil out of the intermediate oil reservoir 96.

The ejector pump 84 and/or the register arrangement 95 for the oil return are advantageously integrated into the oil separator arrangement 10 and form a structural unit therewith. The ejector pump 84 can advantageously be integrated into a cover that closes a housing opening in the housing 41 and/or can be permanently connected thereto. The intermediate reservoir 96 and a closing cover with the oil drain opening are advantageously designed for an oil-tight connection to the housing 41.

The system 90 advantageously does not require a pressure regulating valve of conventional design. Rather, owing to the possibility of regulating the gap width s, the oil separating device 10 can be viewed functionally as a pressure regulating valve. However, an additional pressure regulating valve can be advantageous in particular in Otto engines, where very high negative pressures are possible. In this case, the additional pressure regulating valve can still ensure sufficient negative pressure downstream of the oil separator 10/ejector pump 84, which can be used for separation.

In one possible embodiment, the separating device 10 has a plurality of separators 20 connected in parallel with one another, which are each associated with the actuator or an actuator 46. The separators 20 can be arranged, for example, in the form of a ring around a central through-hole 44 through the carrier 11.

EMBODIMENTS

Embodiment 1. Oil separating device (10) for crankcase ventilation of an internal combustion engine, comprising an oil separator (20) having a gas inlet line (12), which has an outlet end, and a gap-defining element (15), characterised in that the gas inlet line (12) for flowing blow-by gas (13) has an inner wall (3) and an outer wall (4), wherein an inner annular gap (5) is formed or can be formed between the gap-defining element (15) and the outlet end on the inner wall (3) of the gas inlet line (12) and an outer annular gap (6) is formed or can be formed between the gap-defining element (15) and the outlet end of the outer wall (4) of the gas inlet line (12), wherein, in the flow direction, an inner baffle (7) is arranged behind the inner annular gap (5) and an outer baffle (8) is arranged behind the outer annular gap.

Embodiment 2. Oil separating device (10) according to embodiment 1, characterised in that the inner annular gap (5) and the outer annular gap (6) are arranged concentrically.

Embodiment 3. Oil separating device (10) according to either of the preceding embodiments, characterised in that the inner annular gap (5) and the outer annular gap (6) are arranged in a common plane.

Embodiment 4. Oil separating device (10) according to any of the preceding embodiments, characterised in that the inner baffle (7) and the outer baffle (8) are arranged concentrically to one another.

Embodiment 5. Oil separating device (10) according to any of the preceding embodiments, characterised in that the inner baffle (7) and the outer baffle (8) have an annular design.

Embodiment 6. Oil separating device (10) according to any of the preceding embodiments, characterised in that the carrier (17) of the gap-defining element (15) can be inserted and connected into the baffle carrier (16) with the gap-defining element (15).

Embodiment 7. Oil separating device (10) according to any of embodiments 1 to 5, characterised in that the carrier (17) and the baffle carrier (16) are in one piece, wherein the gap-defining element (15) can be inserted and connected into the carrier (17).

Embodiment 8. Oil separating device (10) according to any of the preceding embodiments, characterised in that the oil separating device (10) comprises a spring (53; 54), a spring preloading element (14) and a carrier (11) attached to the gas inlet line (12), which are designed to effect spring preloading onto the gap-defining element (15) with respect to the gas inlet line (12).

Embodiment 9. Oil separating device (10) according to embodiment 8, characterised in that latching means (24) are provided between the spring preloading element (14) and the carrier (11).

Embodiment 10. Oil separating device (10) according to embodiment 9, characterised in that at least two stepped latching means (24) are provided between the spring preloading element (14) and the carrier (11).

Embodiment 11. Oil separating device (10) according to any of the preceding embodiments, characterised in that the oil separating device (10) has a driven actuator (46) for adjusting the gap-defining element (15) relative to the outlet end of the gas inlet line (12).

Embodiment 12. System (90) for crankcase ventilation of an internal combustion engine, comprising an oil separating device (10) according to embodiment 7 and an electronic control means (55) for adjusting, controlling and/or regulating the gap width s of the oil separator (20) by correspondingly triggering the actuator (46).

Embodiment 13. System (90) according to embodiment 12, characterised in that the control means (55) adjusts, controls and/or regulates the gap width s on the basis of the signal from at least one pressure sensor (80-82), differential pressure sensor (83) and/or on the basis of an engine map.

Embodiment 14. System according to embodiment 12 or 13, characterised in that the control means (55) controls the gap width s in such a way that the gap width s is reduced with increasing engine load.

The invention claimed is:

1. An oil separating device for crankcase ventilation of an internal combustion engine, comprising:

an oil separator, wherein the oil separator comprises:

a gas inlet line for flowing blow-by gas in a flow direction, wherein the gas inlet line has an outlet end; and a gap-defining element, wherein the gas inlet line has an inner wall and an outer wall, wherein an inner annular gap is formed between the gap-defining element and an outlet end of the inner wall of the gas inlet line, and an outer annular gap is formed between the gap-defining element and an outlet end of the outer wall of the gas inlet line, wherein, in the flow direction, an inner baffle is arranged behind the inner annular gap and an outer baffle is arranged behind the outer annular gap.

2. The oil separating device according to claim 1, wherein the inner annular gap and the outer annular gap are arranged concentrically.

3. The oil separating device according to claim 1, wherein the inner annular gap and the outer annular gap are arranged in a common plane.

4. The oil separating device according to claim 1, wherein the inner baffle and the outer baffle are arranged concentrically to one another.

5. The oil separating device according to claim 1, wherein the inner baffle and the outer baffle have an annular design.

6. The oil separating device according to claim 1, wherein a carrier of the gap-defining element is inserted and connected into a carrier of the baffle with the gap-defining element.

7. The oil separating device according to claim 6, wherein the carrier of the gap-defining element and the carrier of the baffle are in one piece, wherein the gap-defining element is inserted and connected into the carrier of the gap-defining element.

8. The oil separating device according to claim 1, further comprising:

a spring; a spring preloading element; and a carrier attached to the gas inlet line, which are configured to effect spring preloading onto the gap-defining element with respect to the gas inlet line.

9. The oil separating device according to claim 8, wherein a latch is provided between the spring preloading element and the carrier attached to the gas inlet line.

10. The oil separating device according to claim 8, wherein at least two stepped latches are provided between the spring preloading element and the carrier attached to the gas inlet line.

11. The oil separating device according to claim 1, further comprising:

a driven actuator for adjusting the gap-defining element relative to the outlet end of the gas inlet line.

12. The oil separating device according to claim 1, wherein the inner annular gap and the outer annular gap have the same gap width (s).

13. A system for crankcase ventilation of an internal combustion engine, comprising:

an oil separating device according to claim 1; and an electronic control for adjusting, controlling or regulating a gap width (s) of the outer annular gap of the oil separator or a gap width (s) of the inner annual gap by correspondingly triggering an actuator.

14. The system according to claim 13, wherein the electronic control adjusts, controls or regulates the gap width (s) on the basis of one or more signals from at least one pressure sensor, or at least one differential pressure sensor, or on the basis of an engine map.

15. The system according to claim 14, wherein the electronic control adjusts, controls or regulates the gap width (s) on the basis of one or more signals from at least one pressure sensor.

16. The system according to claim 14, wherein the electronic control adjusts the gap width (s) on the basis of one or more signals from at least one pressure sensor.

17. The system according to claim 13, wherein the electronic control controls the gap width (s) in such a way that the gap width s is reduced with increasing engine load.

18. The system according to claim 13, wherein the inner annular gap and the outer annular gap have the same gap width (s).

19. The system according to claim 13, wherein the electronic control adjusts, controls or regulates the gap width (s) of the outer annular gap of the oil separator and the gap width (s) of the inner annual gap by correspondingly triggering an actuator.

20. The system according to claim 13, wherein the electronic control adjusts the gap width (s) of the outer annular gap of the oil separator and the gap width (s) of the inner annual gap by correspondingly triggering an actuator.

* * * * *